US011724282B2

(12) United States Patent
Triplett

(10) Patent No.: US 11,724,282 B2
(45) Date of Patent: Aug. 15, 2023

(54) MASKING APPARATUS

(71) Applicant: Jason Triplett, Portland, OR (US)

(72) Inventor: Jason Triplett, Portland, OR (US)

( * ) Notice: Subject to any disclaimer, the term of this patent is extended or adjusted under 35 U.S.C. 154(b) by 274 days.

(21) Appl. No.: 16/872,187

(22) Filed: May 11, 2020

(65) Prior Publication Data

US 2020/0338588 A1 Oct. 29, 2020

Related U.S. Application Data

(63) Continuation-in-part of application No. 16/797,062, filed on Feb. 21, 2020, now abandoned.

(60) Provisional application No. 62/808,436, filed on Feb. 21, 2019.

(51) Int. Cl.
*B05C 21/00* (2006.01)

(52) U.S. Cl.
CPC ..... *B05C 21/005* (2013.01)

(58) Field of Classification Search
None
See application file for complete search history.

(56) References Cited

U.S. PATENT DOCUMENTS 4,452,663 A * 6/1984 Heaton ..... E04F 21/1657 156/577
6,684,926 B2 * 2/2004 Matechuk ..... B65H 35/0033 156/577
8,893,941 B2 * 11/2014 Pinto ..... B65H 35/0033 225/56

* cited by examiner

*Primary Examiner* — Jethro M. Pence
(74) *Attorney, Agent, or Firm* — Antonio Papageorgiou, Esq; Lombard & Geliebter LLP

(57) ABSTRACT

An apparatus for applying masking tape to a surface is provided that includes an upper portion and a bottom portion attached to the lower portion, where the upper portion includes a pair of opposing edges separated by a top surface having a basin therein for receiving a placement pad, and a side surface having an inner plank and an outer guide plate, the lower portion includes a masking tape mount oriented relative to surfaces of the opposing edges and top for tape to be passed in a sliding arrangement from the tape mount and along the surfaces of the opposing edges and top.

18 Claims, 13 Drawing Sheets

Figure 13
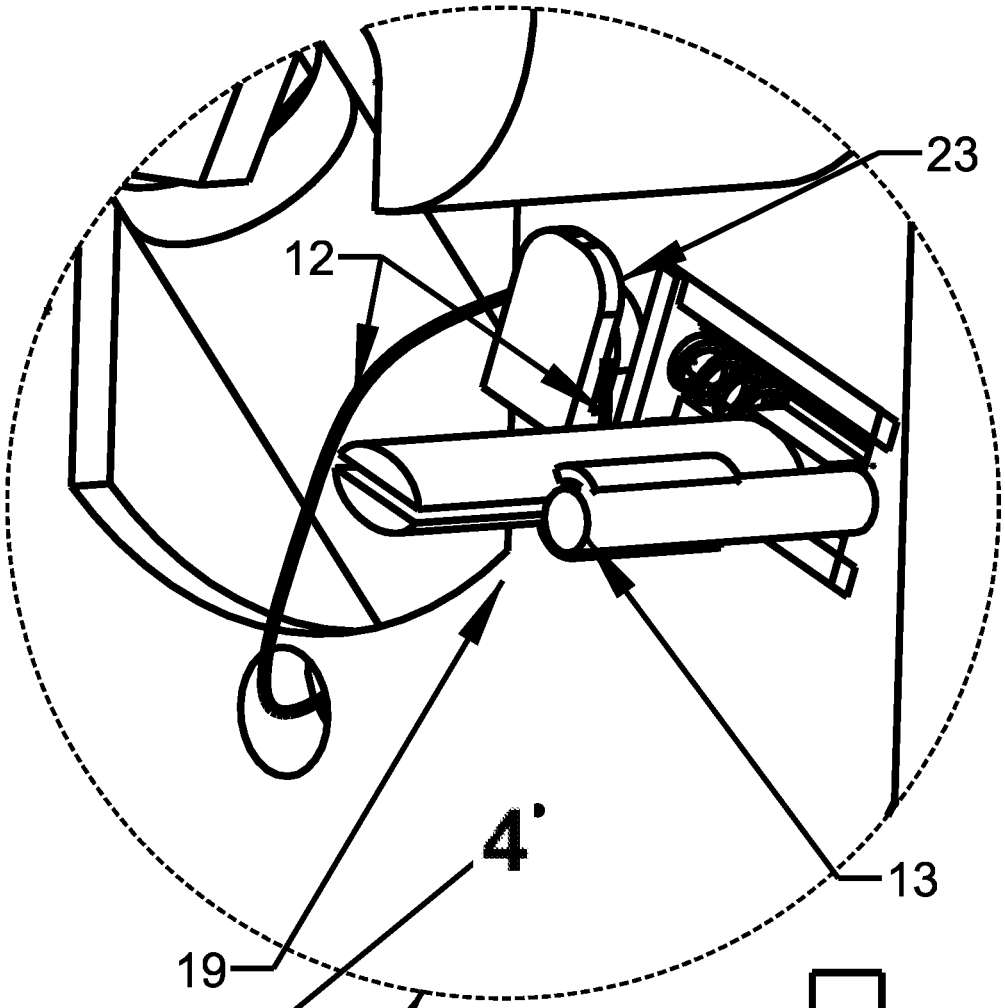
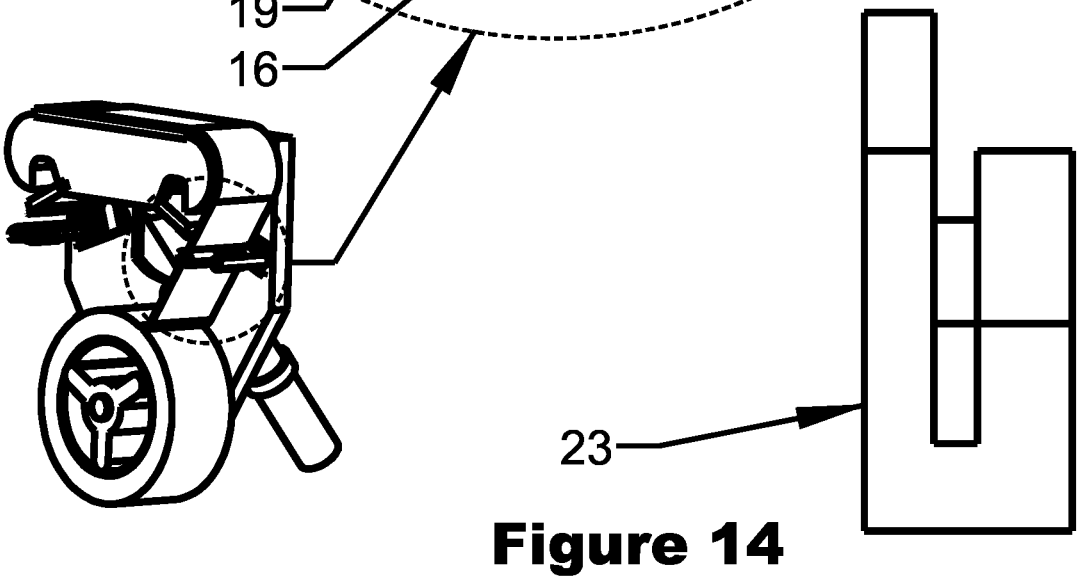
Figure 14

Figure 16b
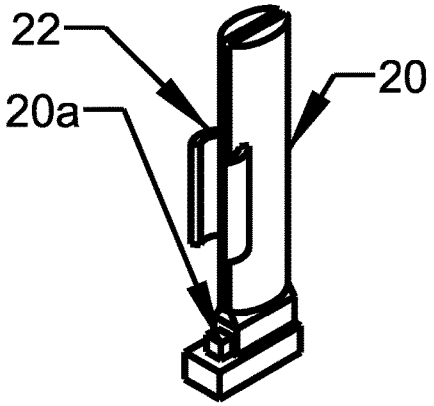
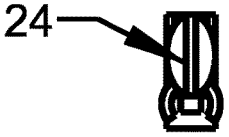
Figure 16a
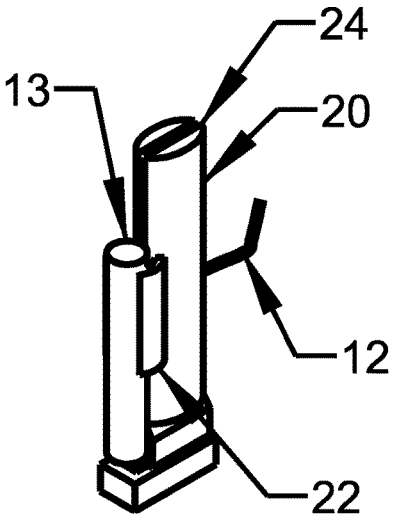
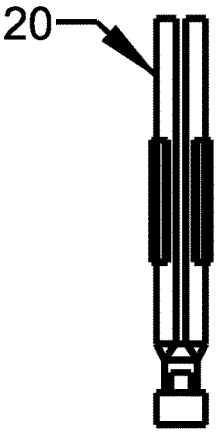
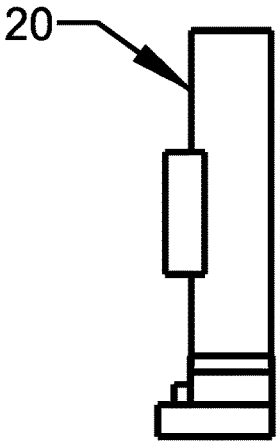
Figure 16c Figure 16d Figure 16e

MASKING APPARATUS

BACKGROUND OF THE INVENTION

This application relates to devices for masking objects in preparation for paint and other finishes.

In looking at recent products, such as the Accubrush® paint edge system, many professional painters have provided customer reviews. Their reviews indicate that, while the goal of this Accubrush® was worthwhile, the product itself did not provide a firm paint line that painters desire for their finished work. In short, most of these painters went ahead and used masking tape to prepare their surfaces for painting, even after buying the Accubrush®. Masking products are typically hand-held applicators, which means that one would still need a step latter in most cases to apply the masking tape. Accordingly, there is a need for a masking apparatus or device that is not limited as such.

SUMMARY OF THE INVENTION

A masking device is provided, which is generally referred to herein as the TaskMasker™ or simply TM, which is a device that may be used by painters (professional and non-professional) to apply masking tape to hard-to-reach areas that would otherwise require the use of a step ladder. The TM may ensure that the masking tape will be flush with 1) the surface to be masked, and 2) the joint between the masked area and the to-be-painted one. In so doing, the TM may help painters prepare their rooms while achieving a solid paint line. This device may save painters considerable time (paint preparation would take far less time) and money.

The TM may be a plastic device that may generally consists of a top platform, an inner wall, a wheel/mount, and stationary blades. The device may contain a u-joint that may have a pole apparatus that may be able to accommodate a standard extension pole that is used for paint rolling. The specific features may be described in further detail in the narrative as well as in the provided sketches.

In at least one aspect, an apparatus for applying masking tape to a surface is provided that includes an upper portion and a bottom portion attached to the lower portion, where the upper portion includes a pair of opposing edges separated by a top surface having a basin therein for receiving a placement pad, and a side surface having an inner plank and an outer guide plate, the lower portion includes a masking tape mount oriented relative to surfaces of the opposing edges and top for tape to be passed in a sliding arrangement from the tape mount and along the surfaces of the opposing edges and top.

In at least one embodiment, at least one of the opposing edges has a rounded profile.

In at least one embodiment, the upper portion is configured for the masking tape to be attached to at least one of the edges and for the masking tape to slide over the top in a direction of the opposing edges.

In at least one embodiment, the upper portion includes at least one peg and wherein at least one of the opposing edges is configured to receive the at least one peg.

In at least one embodiment, the top is at least partially planer and wherein the inner plank is orthogonal to the planer surface of the top.

In at least one embodiment, the upper portion includes a u-joint inner platform below the platform basis for receiving an extension pole.

In at least one embodiment, the lower portion having an inner wall includes at least one blade support plate, the blade support plate includes a blade for cutting the masking tape.

In at least one embodiment, the apparatus includes a plurality of blade supports each having an indentation oriented relative to each other for side surfaces of the guide-plate to fit flush between the indentations.

In at least one embodiment, the apparatus includes at least one trapping peg that receives the masking tape between the mount and the upper portion, and that is movable relative to the blade support for cutting the masking tape when actuated.

In at least one embodiment, the apparatus includes a cable coupled to the trapping peg for actuating the trapping peg.

In at least one embodiment, the trapping peg is coupled to the lower portion with a return spring and wherein the trapping peg when actuated moves toward the blade for cutting the masking tape located on the trapping peg.

In at least one embodiment, the blade is fixed relative to the lower portion and wherein the trapping peg is movable relative to a spring track located on the lower portion, the spring track having a return spring therein that returns the trapping peg to a first position.

In another aspect, an apparatus for applying masking tape to a surface, the apparatus is provided that includes an upper portion and a bottom portion attached to the lower portion, the upper portion includes a pair of opposing edges separated by a top surface having a basin therein for receiving a placement pad, and a side surface having an inner plank and an outer guide plate orthogonal to the top surface, the lower portion includes an inner wall parallel with the side surface of the upper portion and masking tape mount located on the inner wall and oriented relative to surfaces of the opposing edges and top for tape to be passed in a sliding arrangement from the tape mount and along the surfaces of the opposing edges and top, the lower portion further includes a plurality of trapping mechanism and a plurality of blade support plates, each of the trapping mechanisms having a trapping peg slidingly coupled to the lower portion and movable along a spring track when actuated to come into contact with blades associated with the blade support plates.

In at least one embodiment, at least one of the opposing edges has a rounded profile.

In at least one embodiment, the upper portion is configured for the masking tape to be attached to at least one of the edges and for the masking tape to slide over the top in a direction of the opposing edges.

In at least one embodiment, the upper portion includes at least one peg and wherein at least one of the opposing edges is configured to receive the at least one peg.

In at least one embodiment, the top is at least partially planer and wherein the inner plank is orthogonal to the planer surface of the top.

In at least one embodiment, the upper portion includes a u-joint inner platform below the platform basis for receiving an extension pole.

BRIEF DESCRIPTION OF THE FIGURES

FIG. 13 is a viewing of the TM's trapping apparatus, as seen from the front and the side, as well as the interior view of the guide spur, in isolation.

FIG. 14 is a viewing of the TM's trapping apparatus, as seen from the front and the side, as well as the interior view of the guide spur, in isolation.

FIG. 16 is a viewing of the TM's trapping peg, as seen from the top (FIG. 16.*a*), side (FIG. 16.*b*), side (FIG. 16.*c*), front (16.*d*), and side (FIG. 16.*e*).

DETAILED DESCRIPTION OF THE INVENTION

Figure 1:
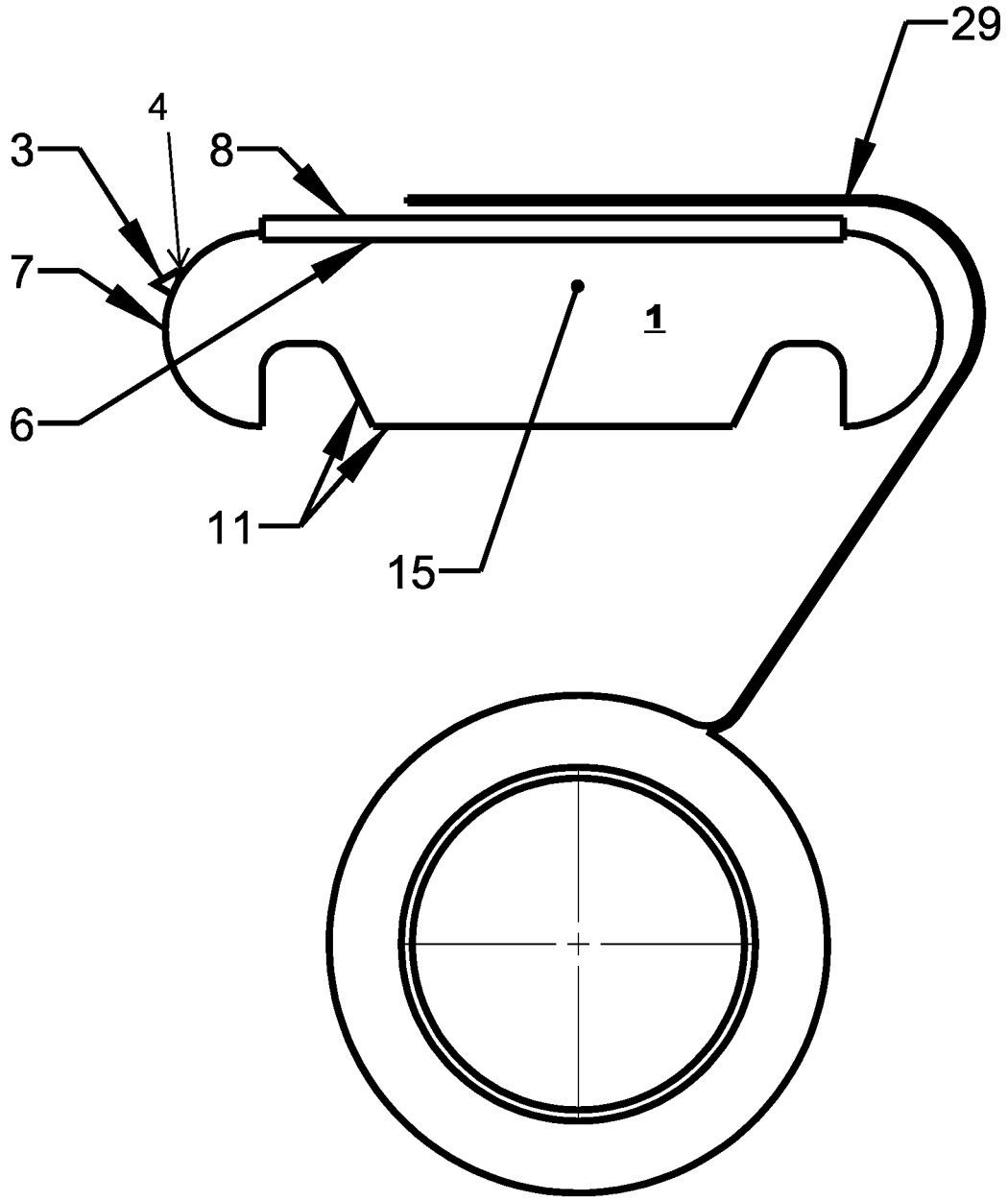
FIG. 1 shows the TM's upper portion, as seen from the front, in isolation.
Figure 9:
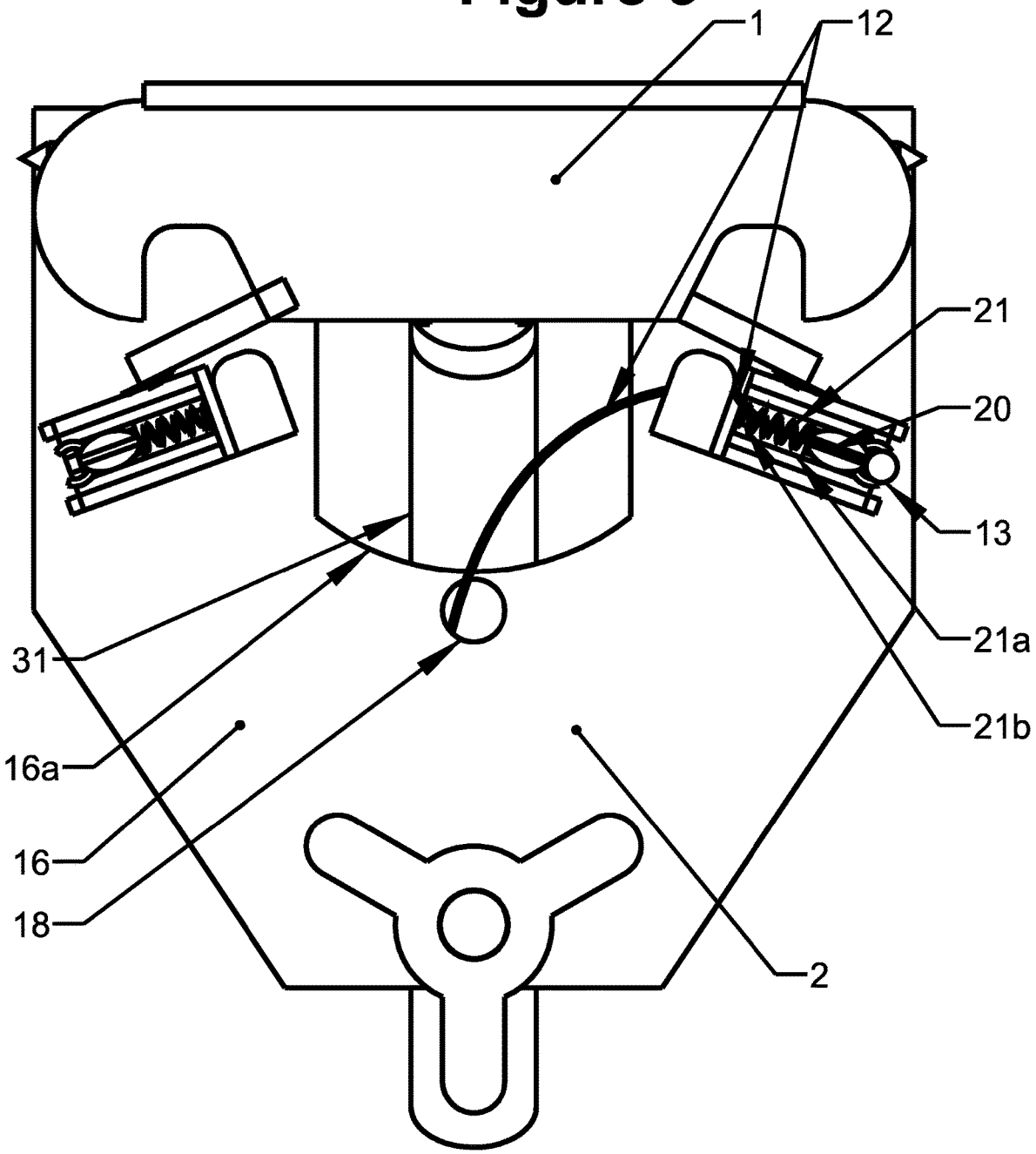
FIG. 9 is a viewing of the TM's inner wall and upper portion.
Figure 15:
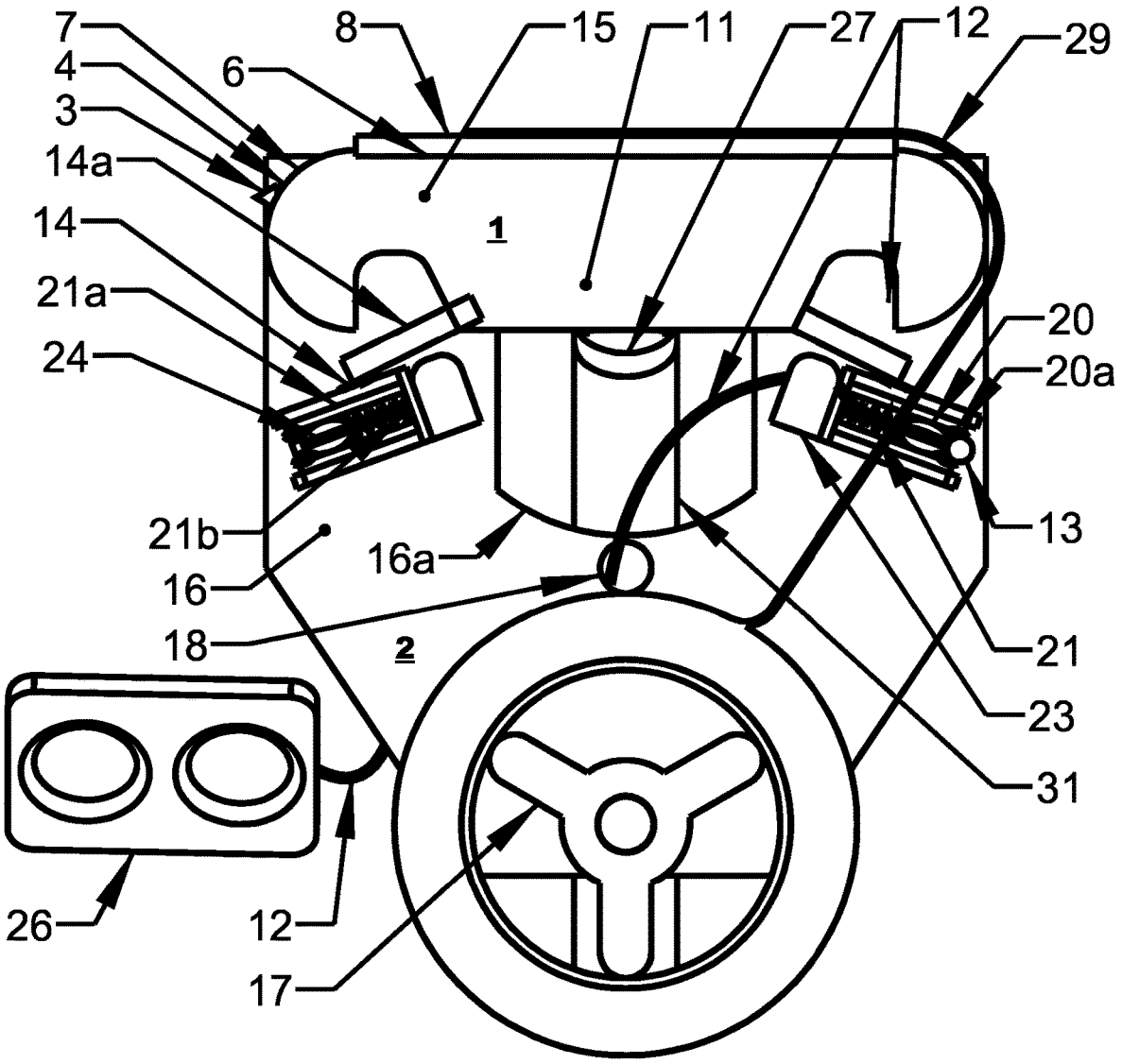
FIG. 15 is a viewing of the TM's upper portion and inner wall and the mechanisms upon which the TM may operate.
Figure 17:
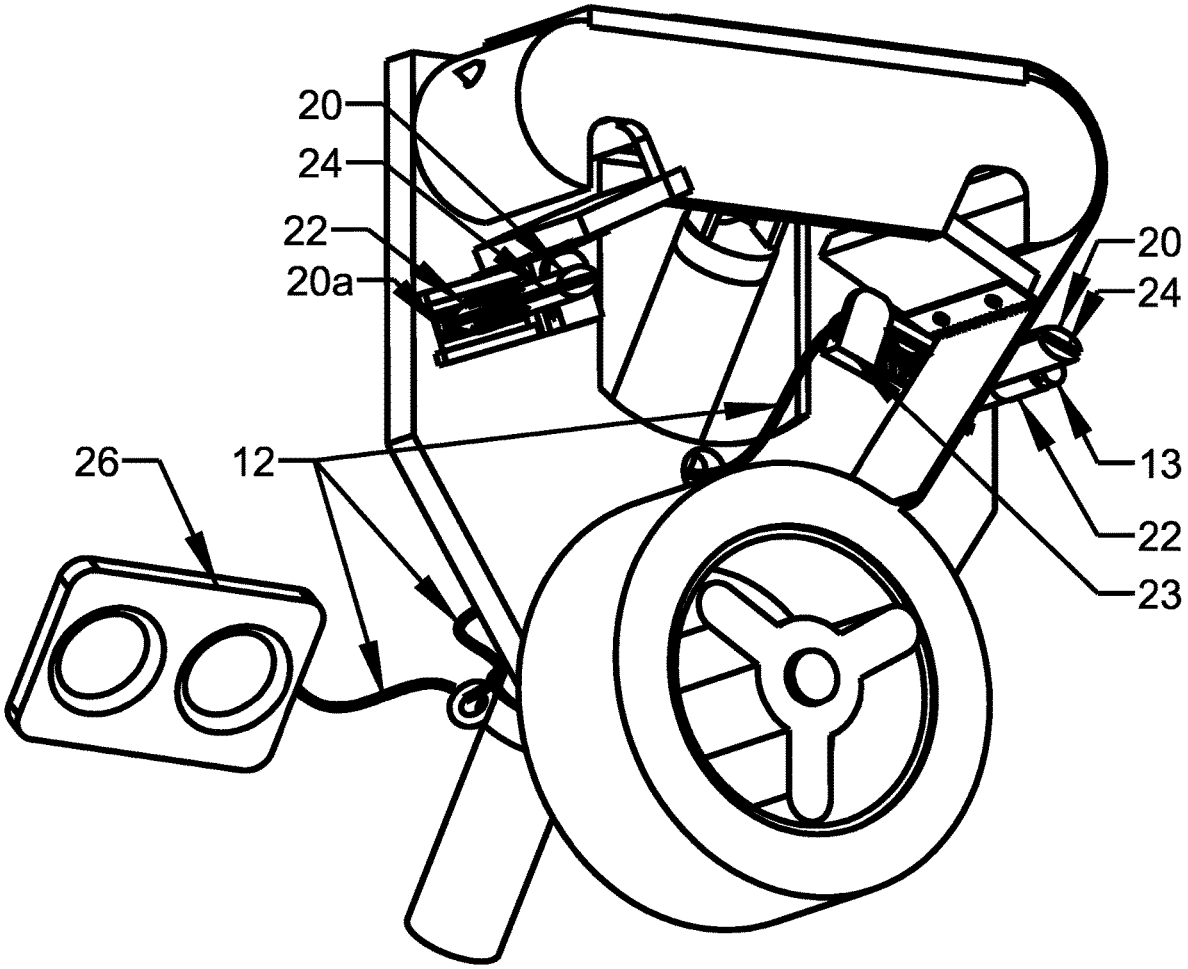
FIG. 17 is a viewing of the TM's trapping peg and apparatus, as seen from the side.

The TM generally includes an upper portion (1) and a lower portion (2). The upper and lower portions generally attached to each other as shown in FIGS. 9, 15, and 17. FIG. 1 shows the TM's upper portion (1), as seen from the front, in isolation. This upper portion includes the two opposing rounded edges (7) over which masking tape (29) will, either, from left-to-right or from right-to-left (depending on the users' preference), slide over the top towards the platform basin (6) and the topside of the placement pad (8). This upper portion has, both, an inner plank (15) and an outer guide plate (11) directly below the inner plank (15) that, when being used, will slide along the surface at an angle opposite of the surface that is to be masked. The rounded, pointy placement peg (3) may be approximately ½ inch long (or less) and may be screwed into the screw thread (4) at the top of whichever of the two opposing rounded edges (7) the user wishes to secure the masking tape (29) at the outset of the application of the masking tape (29) (depending on whether the user wishes to apply the masking tape (29) from left-to-right or right-to-left) and the user would pierce the end of the masking tape (29) into the placement peg (3). It is understood that other securing mechanisms are within the scope of this disclosure. With the masking tape (29) secured in place, the user may apply the TM to the desired surface and, from that point, slide (either to the left or to the right) the TM to apply the masking tape (29).

Figure 2:
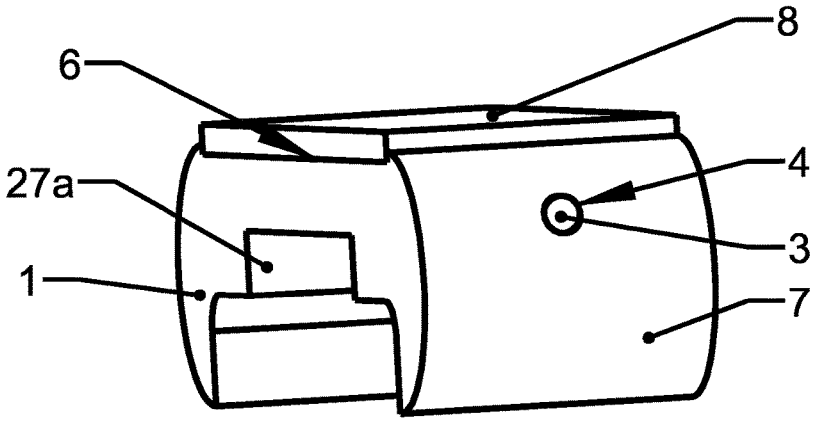
FIG. 2 shows the TM's upper portion, as seen from each of the two sides, in isolation.

FIG. 2 shows the TM's upper portion (1), as seen from the sides, in isolation. The sunken cavity underneath the platform basin (6) is the u-joint inner platform (27.*a*). Towards the top of each of the two opposing rounded edges (7) is a screw thread (4) into which to insert the placement peg (3), onto which the user will pierce and, thus, secure the masking tape onto the placement pad (8) that may fit into the platform basin (6) and, ultimately, onto the desired surface. Once the masking tape is secure and pressed against the desired surface, the user will slide the TM and apply the masking tape, either, from left-to-right or from right-to-left.

Figure 3:
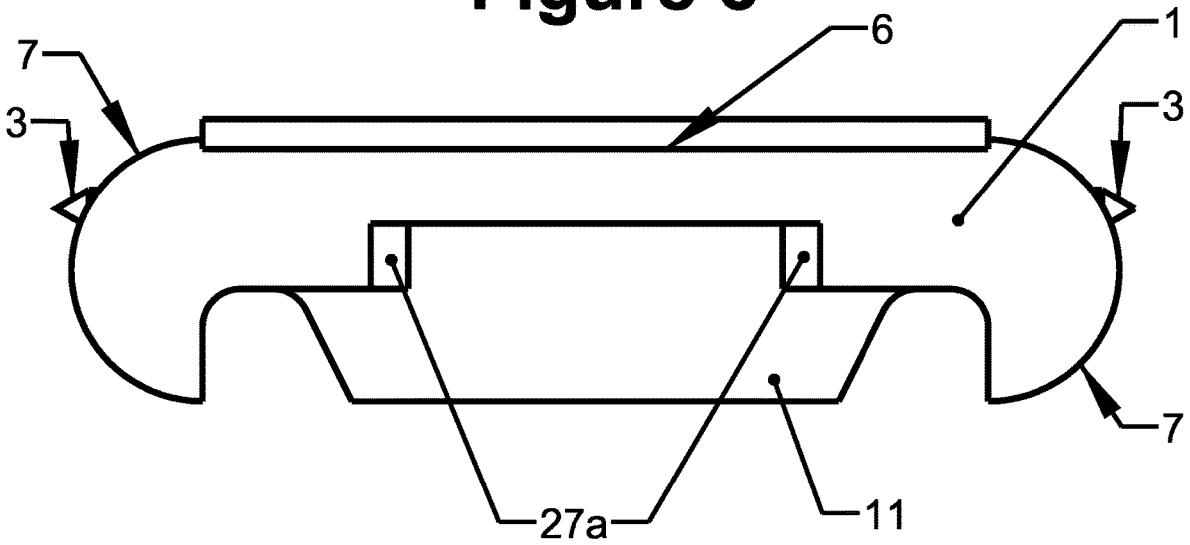
FIG. 3 shows the TM's upper portion, as seen from the rear, in isolation.

FIG. 3 shows the TM's upper portion (1), as seen from the rear, in isolation. An outer guide plate (11) is preferably between ¼ and ⅜$^{th}$ of an inch wide and will be directly below the inner plank. As also shown in FIG. 2, the u-joint inner platform (27.*a*) will be directly below the platform basin (6).

Figure 4:
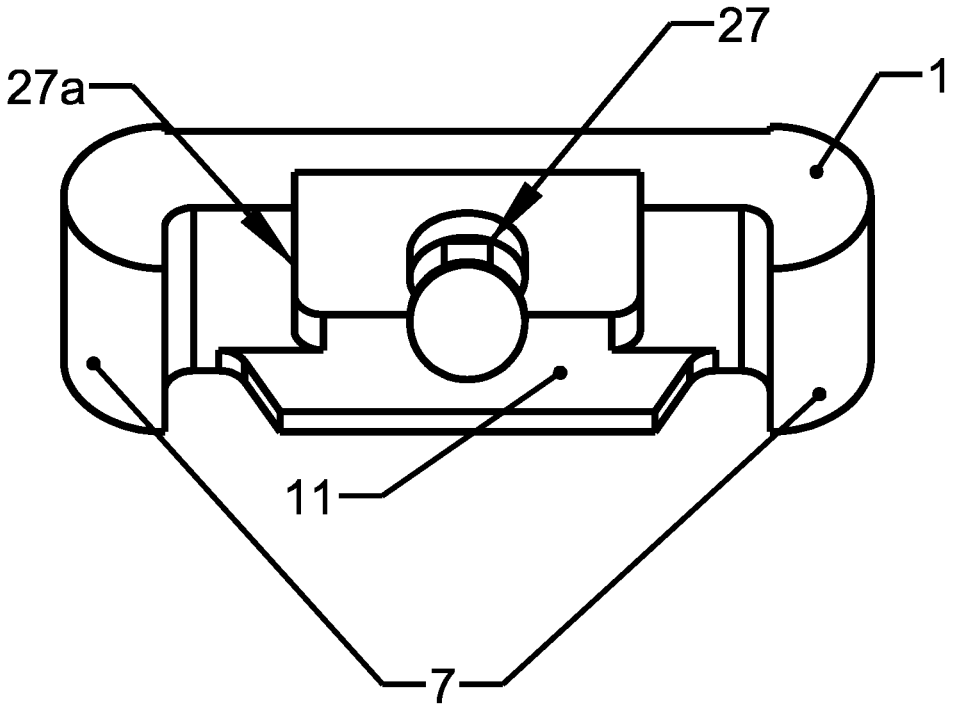
FIG. 4 shows the TM's upper portion, as seen from the bottom, in isolation.

FIG. 4 shows the TM's upper portion (1), as seen from the bottom, in isolation. The bottoms of the rounded edges (7) are shown as is the bottom of an outer guide plate (11) underneath the surfaces of the inner plank that slides along the surface opposite of that being taped. An outer guide plate (11) is in front of a sunken basin (27.*a*) onto which a u-joint may (27) be attached.

Figure 5:
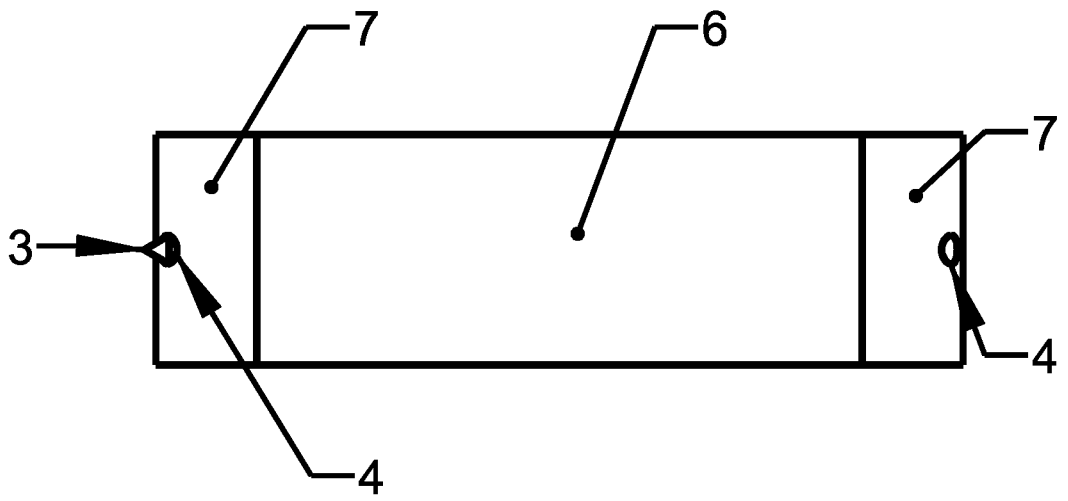
FIG. 5 shows the TM's upper portion as seen from the top, with only the platform's ridge and basin, the latter of which may contain a hook and loop-like surfacing.

FIG. 5 shows the TM as seen from the top, with a platform basin (6) that may contain a hook and loop-like surfacing. The tops of the rounded edges (7) each have a screw thread (4) into which to insert a placement peg (3).

Figure 6:
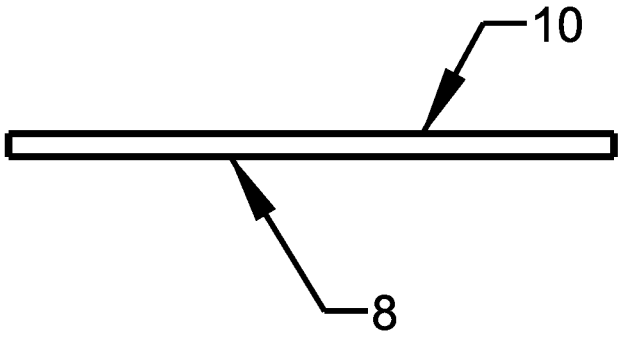
FIG. 6 shows the TM's rubberized placement pad from the side.

FIG. 6 shows the TM's rubberized placement pad (8) from the side. The user would place the potentially hook and loop side (10) of the placement pad (8) onto the platform basin.

Figure 7:
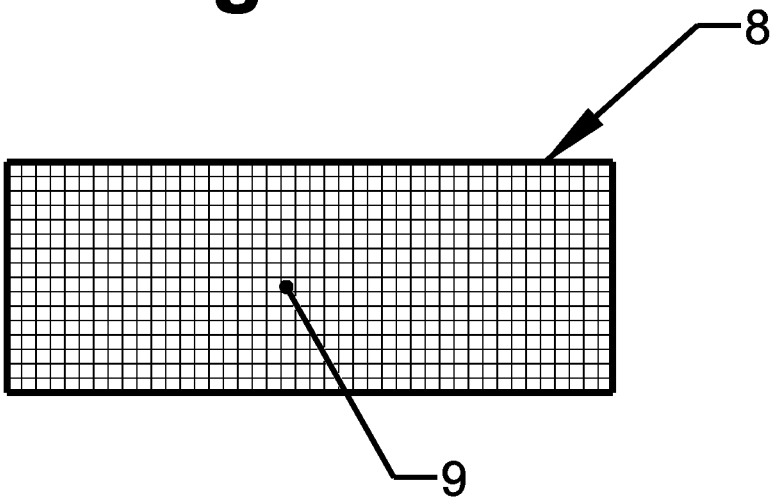
FIG. 7 shows the top of the TM's placement pad, which is a soft cloth surface

FIG. 7 shows the top (9) of the TM's placement pad (8), which may be a soft cloth surface that will enable the smooth sliding underneath the masking tape that is to be applied to the desired surface.

Figure 8:
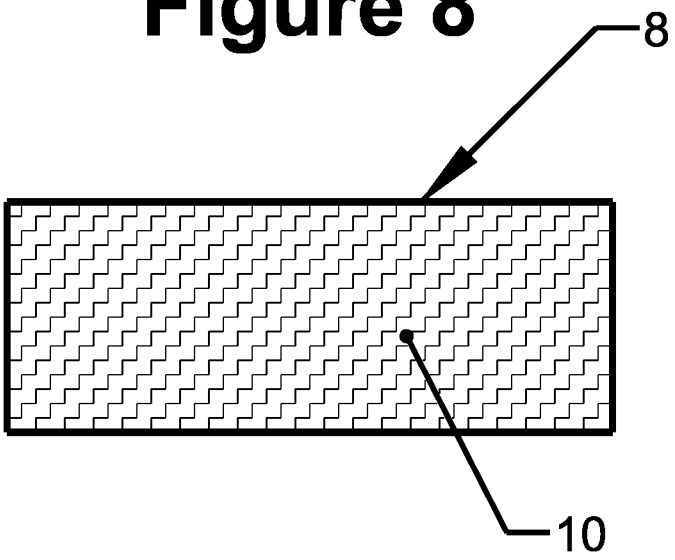
FIG. 8 shows the bottom portion of the TM's placement pad, which contains hook and loop-like surfacing.

FIG. 8 shows the bottom (10) of the TM's placement pad (8), which may contain hook and loop-like surfacing.

FIG. 9 is a viewing of the TM's upper portion (1) and lower portion (2), the latter of which includes an inner wall (16) in isolation. On the inner wall is a view of the uncovered apparatus into which a user will place a spring (21) that may fit above and over a rounded peg (21.*b*) that may be fixed into the inner end of the spring track (21.*a*). The spring tracks (21.*a*) will be big enough to fit the spring (21) that may push trapping pegs (20) against the outer portions (i.e., away from the hollow portion of the inner wall (16.*a*)) of each of the spring tracks (21.*a*). The cable hole (18) would be big enough to pull a cable (12) and pull peg (13) through it. The hollow portion (16.*a*) of the inner wall (16) will allow for an extension pole (31) to poke through and connect to TM's upper portion (1) and maneuver the TM from left-to-right or right-to-left.

Figure 10:
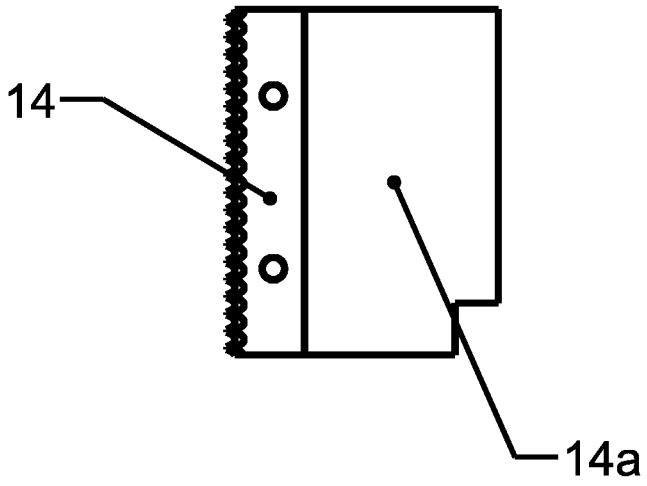
FIG. 10 is a viewing of the TM's blade apparatus, as seen from the bottom, in isolation.
Figure 18:
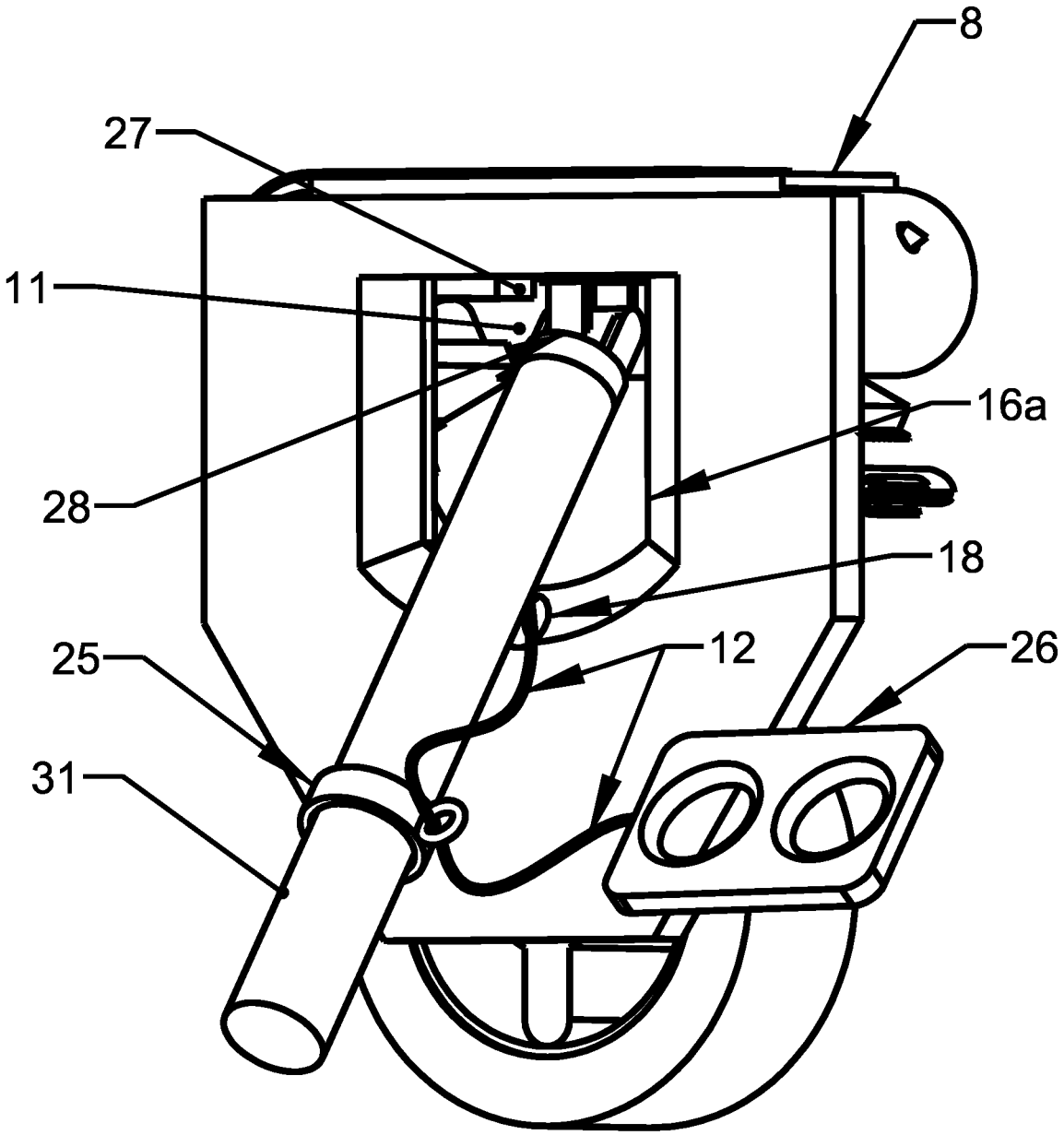
FIG. 18 is the TM's rear view and the mechanisms upon which the TM may operate.

FIG. 10 is a viewing of the TM's blade apparatus (its blade (14) and blade support plate (14.*a*)), as seen from the bottom, in isolation. The blade support plate (14.*a*) may enable a blade (14) to be fastened onto the bottom of the plate (14.*a*), which will be attached to the inner wall of a lower portion as shown in FIGS. 9, 15, and 18, and the indention at the top of the plate (14.*a*) may fit flush against the side of an outer guide plate.

Figure 11:
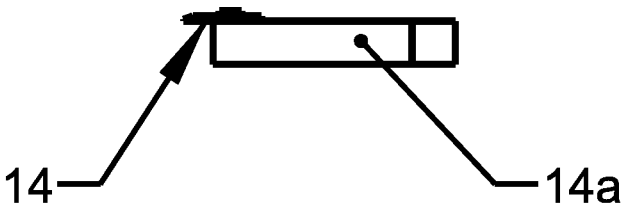
FIG. 11 is a viewing of the TM's blade apparatus, as seen from the side, in isolation.

FIG. 11 is a viewing of the TM's blade (14) and blade support plate (14.*a*), as seen from the side, in isolation.

Figure 12:
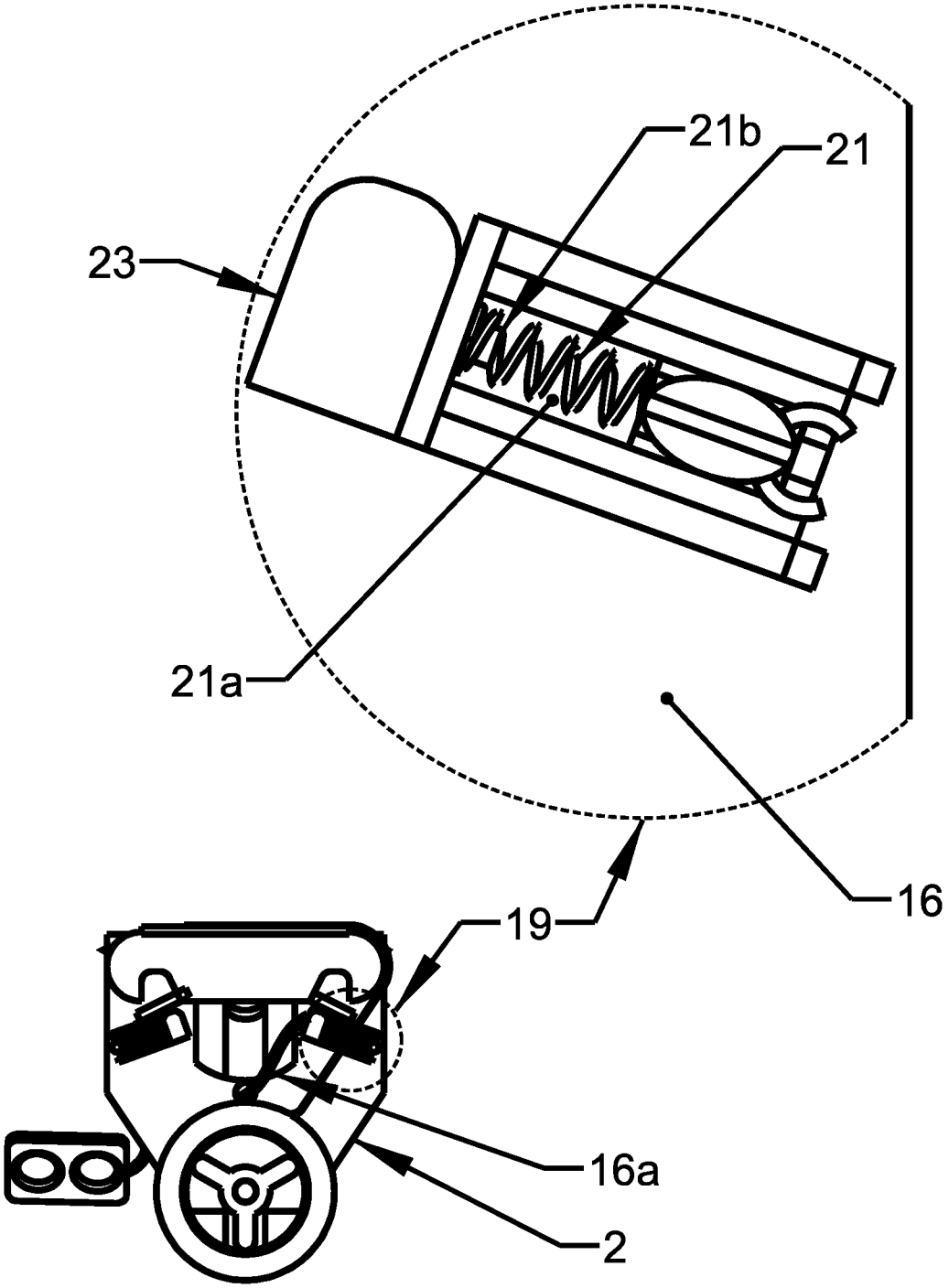
FIG. 12 is a viewing of the TM's trapping apparatus, as seen from the interior, in isolation.

FIG. 12 is a viewing of the TM's trapping apparatus (19), as seen from the interior and of each end of the spring track (21.*a*), in isolation. The trapping apparatus (19) may be on and within each side of the inner wall (16) of lower portion (2) and cover the spring track (21.*a*) that may house the spring (21) as well as the rounded peg (21.*b*) that will be fixed to the inner end of the spring track (21.*a*) of the trapping apparatus (19). As also shown in FIG. 13, the inner end (i.e., in the direction of the hollow portion of the inner wall (16.*a*)) of the trapping apparatus (19) will contain a guide spur (23).

FIG. 13 is, both, a side and interior view of the guide spur (23) that will be fixed on the inner wall (16) past the inner end of the trapping apparatus (19). A cable (12) will slide over the guide spur (23) and travel directly over the center of the spring track within the trapping apparatus (19). The pull peg (13) will be fixed to the end of the cable (12).

FIG. 14 is, both, a side and interior view of the guide spur (23) that will be fixed onto the inner wall (16) past the inner end of the trapping apparatus (19), in isolation.

FIG. 15 is a viewing of the TM's inner wall (16) of the lower portion and the mechanisms upon which the TM may operate, as shown from the front of TM. The upper portion of TM may contain the features that were described in FIGS. 1-4 and preferably include the placement pad (8) fit atop the platform basin (6). A placement peg (3) may be screwed into either of the two screw threads (4) that are, each, towards the top of each rounded edge (7)—the user can pierce the far end of the masking tape (29) onto the placement peg (3) so that the masking tape (29) will stay in place until the user makes first contact of the masking tape (29) with the desired surface to be masked. The inner plank (15) and an outer guide plate (11) surfaces will slide along the surface that would be, generally, at a 90 degree angle opposite the desired surface to be masked, although it is not necessary for the desired surface to have an opposite surface on which the inner plank (15) and outer guide plate (11) would slide against. In this regard, the inner plank (15) and placement pad (8) are preferably about 90 degrees to each other, but may be other angles for different angle walls or surfaces to be taped.

The blade support plate (14.*a*), as described in FIGS. 10-11, may be attached to each side of the inner wall (16) with the outer portion of the plate (14.*a*) flush against the side of an outer guide plate (11)—the blade (14) may be fastened to the bottom of the blade support plate (14.*a*). Directly below the blade support plate (14.*a*) will be the trapping apparatus, which was described in detail in FIGS. 12-14. Below the top (i.e., flush and even with the inner wall) of the trapping apparatus will be a spring (21) that will fit over the top of the rounded peg (21.*b*) fixed onto the inner end of the spring track (21.*a*). The trap peg (20), which is described in further detail in FIG. 16, will rest, and be able to slide back and forth, within the spring track (21.*a*) and be pressed to the back of the spring track (21.*a*) by the spring (21). The trap peg (20) has a slit (24) that may run the length of the middle of the trap peg (20) down to the trap peg base (20.*a*), so that the cable (12), and the pull peg (13) attached to the end of the cable (12), can fit through the cable hole (18) on the inner wall (16) so that the cable can slide over the guide spur (23), travel directly over the center of the spring track (21.*a*), and slide down the slit (24) of the center of the trap peg (20). The pull peg (13) may fit into a mold at the bottom of the rear side of the trap peg (20), ultimately sitting atop the trap peg base (20.*a*) and staying in place with the flexible pull peg housing arms (described further in FIGS. 16*a-e*), and the cable (12) attached to the pull peg (13) will rest at the bottom of the slit (24). The masking tape (29) will travel from the masking tape spool, which may be situated on the masking tape mount (17), through the space between the trapping peg (20) and the blade (14) and blade plate (14.*a*) and over the outside edge (7) and onto the topside (9) of the placement pad (8), until the user can pierce the end of the masking tape (29) onto the placement peg (3) near the top of the rounded edge (7). The extension pole (31) may go through the hollow portion of the inner wall (16.*a*) and, as further shown in FIG. 21, connect to an extension pole casing that will connect to a u-joint (27) that will be fastened into the u-joint inner platform directly below the platform basin (6). Once the masking tape (29) is secure atop the placement pad (8), the user will use the extension pole (31) to press TM against the desired surface to apply the masking tape (29). The user will use the extension pole (31) to move the TM from one side to the next. Once the user decides to cut the masking tape (29), the user will use the cable handle (26), which is attached to the cable (12), to pull the cable (12) that may come through the cable hole (18) and be connected to the pull peg (13) and slide over the guide spur (23) and over the top of the spring track (21.*a*) and down the slit (24) within the center of the trapping peg (20) so that the pull peg (13) may be housed within the pull peg housing that is at the rear of the trapping peg (20), which will pull the adhesive side of the masking tape (29) into the blade (14) that may be fastened to the blade plate (14.*a*). An outer guide plate (11) can be seen below the inner plank (15) and behind the blade support plate (14.*a*).

FIGS. 16*a-e* is a viewing of the TM's trapping peg (20), as seen from the front, side, rear, and an expanded view of the top, in isolation. The slit (24) down the center of the trap peg (20) allows a cable (12) to slide down to the base (20.*a*) and the bottom of the slit (24) and for a pull peg (13) to fit atop the base (20.*a*) and be clasped into place within the pull peg housing arms (22) and fit snugly within a mold at the bottom rear of the trap peg (20).

FIG. 17 is a viewing of the TM's trapping peg (20) and trapping apparatus, including the guide spur (23) that is flush with the inner wall, as seen from the side. As also shown in FIG. 15, the cable (12) will loop over the top of the guide spur (23) and slide over the inner edge of the guide spur (23) and the user will slip the cable (12) down the length of the slit (24) of the trap peg (20) so that the pull peg (13) can fit into a mold in the bottom rear of the trap peg (20) and atop the trap peg base (20.*a*) and be clasped into place with the flexible arms of the pull peg housing (22). When the user wishes to cut the masking tape, the user will use the cable handle (26) to pull the cable (12), which will pull the pull peg (13) into a trapping peg (20), which will push the masking tape into a blade.

FIG. 18 is the TM's rear view and the mechanisms upon which the TM may operate. The extension pole (31) may go through the hollow portion of the inner wall (16.*a*) and, as further shown in FIG. 18, connect to an extension pole casing (28) that will connect to a u-joint (27) that will be fastened into the u-joint inner platform directly below the platform basin (6), which will house the placement pad (8), and behind the guide plate (11). The pull peg on the end of the cable (12) will go through the cable hole (18). The user may use a cable handle (26) to pull the cable through the loop within the cable bracket (25) to activate the cutting mechanism.

Referring to FIGS. 1-5, the TM includes a platform basin (6) that may be a flat plastic plate that is slightly sunken within the center of the top of the upper portion (1) of TM. The platform basin (6) may be slightly wider than a standard-sized strand of masking tape (29), while longer than a full tape spool diameter, with a slight indention to make room for a placement pad (8). The platform basin (6) may contain a hook and loop-like gripping material that may grip the bottom side (10) of the rubberized placement press pad (8), as shown in FIGS. 6-8—the bottom side (10) may contain material that will grip to the hook and loop-like surface on the platform basin (6). The fluffy topside (9) of the press pad (8) may help the masking tape (29), both, slide smoothly and grip an uneven surface, such as a ceiling or a wall.

As shown in FIGS. 1, 15, and 18, the inner plank (15) below the platform basin (6) may be approximately 1-1.5 inches thick. Extending from below the center of the inner plank (15) may be an outer guide plate (11) as well as the u-joint inner platform (27.*a*), to which a u-joint (27) may be fastened and which may connect to an extension casing (28).

As seen in FIGS. 4 and 18, the TM may have a u-joint (27) within the inner platform (27.*a*) directly below the center of the platform basin (6) and in between the top of the inner wall (16) and an outer guide plate (11). The u-joint (27) may connect to an extension pole casing (28), into which the user may fasten an extension pole (31) with which the user can push TM from one side of the room to the next. Together, the extension pole (31) and u-joint (27) may provide the user with the necessary maneuverability and directional control for the TM as the TM (and, ultimately, the masking tape (29)) is pressed against the desired surface.

Fixed to the u-joint (27) may be the extension pole casing (28), which may poke through the hollow portion (16.*a*) of the inner wall (16), as shown in FIGS. 15, 17, and 18. The pole casing (28) may be able to accommodate any standard extension pole (31) that could be used for painting.

As shown in FIGS. 1-5 and 15, on each end of the platform basin (6) may be a rounded edge (7) in order to guide the masking tape (29) up either of the opposing rounded edges (7) and along the top of fluffy topside (9) of the press pad (8) towards the joint (i.e., the intersection of the masked surface and surrounding area. E.g. the joint between the top of a wall and the end of a ceiling), depending on which direction the painter wishes to apply the masking tape (29).

As shown in FIGS. 2 and 5, there may be a screw thread (4) embedded into each of the two plastic rounded edges (7). Depending on which direction the painter applies the masking tape (29), the placement peg (3) can be screwed into either of the screw threads (4) that are embedded in their respective opposing rounded edges (7). The placement peg (3) may be used to secure the end of the masking tape (29) along the topside (9) of the press pad (8) prior to the masking tape's initial contact with the masked surface. Once the initial contact is established, the painter may push the TM and apply the masking tape (29) against the desired masked surface, from one corner of the room to the other.

Connected to each side of the inner wall (16) may be a trapping apparatus (19), as shown in FIGS. 12-13 and 15-17, along with a stationary blade (14), as shown in FIGS. 10-11, depending on which direction the painter wishes to apply the tape (29). As the painter pushes the TM from left to right, or from right to left, the TM applies the masking tape (29) against the desired masking surface. In so doing, and as shown in FIGS. 15 and 17, the masking tape (29) may travel from the masking tape wheel/mount (17) over the trapping apparatus (19) between the trap peg (20) and the guide spur (23), the latter of which is below the blade support plate (14.*a*). The masking tape (29) may continue over the top of one of the two opposing rounded edges (7), with the non-adhesive side of the masking tape (29) sliding over the topside (9) with the adhesive side gripping the desired surface.

Along the standard extension pole (31), the painter may fasten a cable bracket (25), as shown in FIG. 18, that may contain a loop through which the painter may thread a cable (12) that may contain a pull peg (13) on one end, as shown in FIG. 17, and a cable handle (26) on the other end. The cable (12) and pull peg (13) may further thread through the cable hole (18) below the hollow portion of the inner wall (16.*a*), as shown in FIGS. 15, 17 and 18.

From the cable hole (18), the cable (12) may travel over and along the desired guide spur (23), over the top of the spring (21) and the spring's track (21.*a*), down the slit (24) of the trap peg (20), as shown in FIGS. 13-17. The painter may place the pull peg (13) into the pull peg housing arms (22), onto the trap peg base (20.*a*), and into a mold at the bottom rear of the desired trap peg (20), as the cable (12) may slide down the narrowing opening of the pull peg housing (22). Once the trapping apparatus (19) is fully engaged, the painter may be able to cut the masking tape (29) at the desired location.

As shown in FIGS. 15, 17, and 18, the user may achieve cutting the masking tape (29) by utilizing the cable handle (26) with one hand to pull the cable (12), which will travel through the cable hole (18) and up the inner wall (16) towards and over the inner portion of the guide spur (23), over the top of the spring (21) and spring track (21.*a*) until the cable (12) slides down the slit (24) of the center of the trapping peg (20) so that the pull peg (13) can be held in place, clasped into the pull peg housing arms (22), atop the trap peg base (20.*a*) and within a mold at the bottom rear of the trap peg (20). This may ultimately activate the pull peg (13) into pulling the trap peg (20) into the adhesive side of the masking tape (29) and towards the blade (14) and in the direction of the guide spur (23) on the other end of the spring track (21.*a*). In so doing, the trap peg (20) may slow or stop the flow of the masking tape (29) and create the necessary tension on the masking tape (29) between the spool on the masking tape wheel/mount (17) and the desired opposing rounded edge (7). Once the masking tape (29) is effectively trapped against the trap peg (20), the trap peg (20) may pull the taut masking tape (29) into the desired stationary blade (14).

On the inner wall (16) as demonstrated in FIGS. 15 and 17, there may be a wheel/mount (17), which may be screwed into place by a screw that can be tightened into the inner wall (16) with a screwdriver. The wheel/mount (17) may be just big enough in diameter to fit a standard-sized spool. The tape spool may fit snugly onto, and firmly against the end of, the wheel/mount (17) so that the spool does not make contact with the inner wall (16) and so that the wheel mount (17) and spool do not impede the cable (12) coming out of the cable hole (18) and up and into the groove within the guide spur (23). At the same time, the spool may fit onto the masking tape wheel/mount (17) so that the masking tape (29) may travel from a point that is directly below the width of the desired rounded edge (7) to ensure a reliable direction of the masking tape (29) along the seam and desired, masked surface. Further, the location of the masking tape spool on the masking tape wheel/mount (17) may allow the outer rim of the spool to barely graze the area (e.g., the top of the wall) below, both, the inner plank (15)/outer guide plate (11) and the joint.

While the foregoing invention has been described in some detail for purposes of clarity and understanding, it will be appreciated by one skilled in the art, from a reading of the disclosure, that various changes in form and detail can be made without departing from the true scope of the invention.

What is claimed is:

1. An apparatus for applying masking tape to a surface, the apparatus comprising:

an upper portion; and a lower portion attached to the upper portion, the upper portion comprising a pair of fixed opposing edges attached to and separated from each other by a top surface extending continually between them, the top surface having a recessed basin therein for receiving a placement pad, and a planar side surface having an inner plank and an outer guide plate, the planar side surface fixedly extending continually between the opposing edges, the lower portion comprising a masking tape mount oriented relative to surfaces of the opposing edges and the top surface for masking tape to be passed in a sliding arrangement from the masking tape mount and over the surfaces of the opposing edges and the top surface.

2. The apparatus of claim 1, wherein at least one of the opposing edges has a rounded profile at an intersection of the at least one of the opposing edges and the top surface.

3. The apparatus of claim 1, wherein the upper portion is configured for the masking tape to be attached to at least one of the opposing edges and for the masking tape to slide over the top surface in a direction of the opposing edges.

4. The apparatus of claim 3, the upper portion comprising at least one placement peg and wherein at least one of the opposing edges is configured to receive the at least one placement peg, the at least one placement peg extending outward from an outward surface of the opposing edge configured to receive the at least one placement peg.

5. The apparatus of claim 3, wherein the top surface is at least partially planar and wherein the inner plank is orthogonal to the planar surface of the top surface.

6. The apparatus of claim 1, the upper portion comprising a u-joint inner platform below the recessed basin for receiving an extension pole.

7. The apparatus of claim 1, the lower portion having an inner wall comprising at least one blade support plate, the blade support plate comprising a blade for cutting the masking tape.

8. The apparatus of claim 7, comprising a plurality of blade support[s] plates each having an indentation oriented relative to each other for side surfaces of a guide plate to fit flush between the indentations.

9. The apparatus of claim 7, comprising at least one trapping peg that receives the masking tape between the masking tape mount and the upper portion, and that is movable relative to the blade for cutting the masking tape when actuated.

10. The apparatus of claim 9, comprising a cable coupled to a pull peg for actuating the trapping peg.

11. The apparatus of claim 9, wherein the trapping peg is coupled to at least one track, within the lower portion, with a return spring and wherein the trapping peg when actuated moves toward the blade for cutting the masking tape located on the trapping peg.

12. The apparatus of claim 9, wherein the blade is fixed relative to the lower portion and wherein the trapping peg is movable relative to a spring track located on the lower portion, the spring track having a return spring therein that returns the trapping peg to a first position.

13. An apparatus for applying masking tape to a surface, the apparatus comprising:

an upper portion; and a lower portion attached to the upper portion, the upper portion comprising a plurality of opposing edges attached to and separated from each other by a top surface extending continually between them, the top surface having a recessed basin therein for receiving a placement pad, and a planar side surface having an inner plank and an outer guide plate orthogonal to the top surface, the planar side surface fixedly extending continually between the opposing edges, the lower portion comprising an inner wall parallel with the planar side surface of the upper portion and masking tape mount located on the inner wall and oriented relative to surfaces of the opposing edges and the top surface for masking tape to be passed in a sliding arrangement from the masking tape mount and over the surfaces of the opposing edges and the top surface, the lower portion further comprising a plurality of trapping mechanisms and a plurality of blade support plates, each of the trapping mechanisms having a trapping peg slidingly coupled to the lower portion and movable along a spring track when actuated to come into contact with blades associated with the blade support plates.

14. The apparatus of claim 13, wherein at least one of the opposing edges has a rounded profile at an intersection of the at least one of the opposing edges and the top surface.

15. The apparatus of claim 13, wherein the upper portion is configured for the masking tape to be attached to at least one of the opposing edges and for the masking tape to slide over the top surface in a direction of the opposing edges.

16. The apparatus of claim 15, the upper portion comprising at least one peg and wherein at least one of the opposing edges is configured to receive the at least one peg, the at least one placement peg extending outward from an outward surface of the opposing edge configured to receive the at least one placement peg.

17. The apparatus of claim 15, wherein the top surface is at least partially planar and wherein the inner plank is orthogonal to the planar surface of the top surface.

18. The apparatus of claim 13, the upper portion comprising a u-joint inner platform below the recessed basin for receiving an extension pole.

* * * * *